US006224430B1

(12) United States Patent
Kusuda et al.

(10) Patent No.: US 6,224,430 B1
(45) Date of Patent: May 1, 2001

(54) POWER SUPPLY TERMINAL ASSEMBLY

(75) Inventors: Kiyonori Kusuda; Hiroshi Kadoya; Kenji Tsutsumi; Setuo Kojima; Kenji Toshimitsu, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/451,131

(22) Filed: Nov. 30, 1999

(30) Foreign Application Priority Data

Feb. 26, 1999 (JP) ..... 11-049319

(51) Int. Cl.[7] ..... H01R 9/22
(52) U.S. Cl. ..... 439/709; 439/733.1; 439/947
(58) Field of Search ..... 439/68, 78, 709, 439/712, 801, 814, 733.1, 947

(56) References Cited

U.S. PATENT DOCUMENTS 1,659,303 * 2/1928 Rovere .
3,979,615 * 9/1976 Neff ..... 310/71
4,191,440 * 3/1980 Schramm ..... 339/17
4,790,764 * 12/1988 Dawaguchi et al. ..... 439/78
5,158,471 * 10/1992 Fedder et al. ..... 439/80
5,630,720 * 5/1997 Kocher ..... 439/78

FOREIGN PATENT DOCUMENTS 0 054 377 * 6/1982 (EP) .

* cited by examiner

*Primary Examiner*—Brian Sircus
*Assistant Examiner*—Than-Tam Le
(74) *Attorney, Agent, or Firm*—Helfgott & Karas, P.C.

(57) ABSTRACT

A power supply terminal assembly for use on a board and having a construction which is capable of improving working efficiency in mounting the power supply terminal assembly onto the board and enhancing mechanical strength of each power supply terminal. The power supply terminal assembly for supplying electric power to a back wiring board (BWB) comprises a terminal block formed with a pair of through slits and a screw hole at a center between the pair of through slits, and a terminal bracket bent into a U-shape and having a flat central plate portion formed therethrough with a hole corresponding to the screw hole and opposite side plate portions each formed with a plurality of press-fit terminals at an end thereof, the opposite side plate portions being inserted through the pair of through slits, respectively, and fixed thereat.

4 Claims, 8 Drawing Sheets

POWER SUPPLY TERMINAL ASSEMBLY

BACKGROUND OF THE INVENTION

1. Field of the Invention

The present invention relates to a power supply terminal assembly for supplying electric power to a board, and more particularly to a power supply terminal assembly for use on a back wiring board (BWB) of a communication device.

2. Description of the Related Art

In recent years, communication systems have been required to have a higher-density structure, a larger information-transmitting capacity, and more sophisticated capabilities, due to an upsurge in the use of data communications and the like.

Under the circumstances, each communication device tends to consume an increased amount of electric power and hence is required to be capable of handling a large current.

Further, back wiring boards (BWBs) of the communication devices keep on becoming highly multilayered, and with an increase in the layers of their multilayered structure, they are becoming thicker and thicker.

Connectors for supplying electric power to BWB are mostly of solderless connection type in which connection are established by press-fitting in a matched impedance configuration so as to allow high-frequency signals to pass therethrough.

Conventionally, electric power is supplied to a BWB based on the following constructions:

In a first construction, electric wires each having one end thereof soldered to a power terminal are inserted into respective through holes formed through a BWB for soldered connection between the electric wires and the BWB.

According to this construction, power supply capacity is determined depending on the number of the electric wires and a diameter of each electric wire which is dependent on current capacity of a power source, so that it is required to increase the number of electric wires or the diameter of each electric wire so as to make the BWB capable of handling large currents.

In a second construction, electric power is supplied through press-fit power connectors. In this case, the press-fit power connectors are embedded in a BWB, and a power source side is also provided with connectors.

According to this construction, power supply capacity is determined depending on the number of the press-fit power connectors and that of pins of each press-fit power connector, so that it is required to increase the press-fit power connectors or the connector pins in number so as to make the BWB using this construction capable of handling large currents.

A third construction is one in which a plurality of press-fit terminals are mounted separately. This construction will be described below with reference to FIGS. 6(A) and 6(B). FIGS. 6(A) and 6(B) show the construction of a press-fit terminal employed in this construction.

The press-fit terminal 10 shown in FIGS. 6(A) and 6(B) has a body 11 bent into a U-shape and having opposite ends thereof formed with comb teeth-shaped press-fit terminal pins 12*a* to 12*e*. Further, at a center of a flat central portion of the body 11, there is formed a through screw hole 13 into which a screw 1 is screwed. Reference numeral 2 indicates a sectional view of the press-fit terminal 10 taken on line 6(B)—6(B) in FIG. 6A.

Next, a procedure of mounting the press-fit terminal 10 constructed as above onto a BWB will be described with reference to FIGS. 7(A) and 7(B). FIGS. 7(A) and 7(B) show a plurality of press-fit terminals mounted in the BWB. FIG. 7(A) is a plan view, while FIG. 7(B) is a sectional view taken on line B—B of FIG. 7(A).

As shown in FIGS. 7(A) and 7(B), in wiring by the use of the press-fit terminals 10*a* to 10*e*, the press-fit terminal pins 12*a* to 12*e* of the press-fit terminals 10*a* to 10*e* are each separately inserted into a pair of through holes formed through the BWB 20 and fixed thereat. Then, the screws 1*a* to 1*e* are screwed respectively into the screw holes 13 (see FIGS. 6(A) and 6(B)) of the press-fit terminals 10*a* to 10*e* via crimp terminals 3*a* to 3*e* (appearing in FIG. 7(B)) for electric wires.

Instead of using the crimp terminals 3*a* to 3*e*, the wires may be wound around the screws 1*a* to 1*e*, respectively, connection to the press-fit terminals 10*a* to 10*e*.

According to the third construction, current capacity depends on the number of the press-fit terminal pins and the diameter of each connectable wire.

However, the first construction requires a structure for mounting of the mechanism. Further, when the apparatus using the BWB consumes a large amount of electric power, it is required to connect a plurality of electric wires to one terminal or use wires having a large diameter, which degrades manufacturing efficiency. Further, when the electric wires are increased in number, it is also required to increase mounting space. Moreover, an increase in thickness of the BWB can cause defective soldered connections.

The second construction using press-fit power connectors is mechanically retained by connectors, so that it is inferior in ruggedness. In addition, since this construction is a connector-type, erroneous wiring can be carried out when the number of electrodes of one press-fit power connector is identical to that of electrodes of another press-fit power connector, and hence voltage-monitoring capability is required for checking the wiring.

As far as the third construction is concerned, the body of each of the press-fit terminals used therein is formed with the screw hole having a female screw thread directly cut therein (e.g. by burring) for connection to an electric wire. The strength of this structure against tightening by a screw is dependent on thickness and material of the terminal itself, so that a small terminal as shown in FIGS. 6(A) and 6(B) is not reliable in strength of its body.

Further, since the terminals are mounted separately in the BWB as shown in FIGS. 7(A) and 7(B), manufacturing efficiency is low. Further, if terminals are arranged close to each other, a feeder to be connected or actually connected to a corresponding one of the terminals can come into contact with an adjacent terminal when it is connected or in the connected state.

Moreover, the screw hole 13 of the press-fit terminal is a through hole. Therefore, so long as a screw 1 having an appropriate length is used as shown in FIG. 8(A), there is no problem. However, as shown in FIG. 8(B), if a long screw if is used, there is a problem that an end of the screw damages the BWB and the terminal falls off the BWB as indicated by reference numeral 3 therein.

SUMMARY OF THE INVENTION

It is an object of the invention to provide a power supply terminal assembly for supplying electric power to a board. The power supply terminal assembly is characterized by comprising a terminal block formed with a pair of through slits and a screw hole at a center between the pair of through slits, and a terminal bracket bent into a U-shape and having a flat central plate portion formed therethrough with a hole corresponding to the screw hole and opposite side plate portions each formed with a plurality of press-fit terminals at an end thereof, the opposite side plate portions being inserted through the pair of through slits, respectively, and fixed thereat.

It is another object of the invention to provide a power supply terminal assembly having enhanced mechanical strength of each power supply terminal.

The above and other objects, features and advantages of the present invention will become apparent from the following description when taken in conjunction with the accompanying drawings which illustrate a preferred embodiment of the present invention by way of example.

BRIEF DESCRIPTION OF THE DRAWINGS

FIGS. 4(A) to 4(C) are views showing the construction of a terminal bracket in detail, in which:

FIG. 4(A) is a plan view of the terminal bracket;

FIG. 4(B) is a front view of the terminal bracket; and

FIG. 4(C) is a side view of the terminal bracket;

FIGS. 7(A) and 7(B) are views showing conventional press-fit terminals mounted on the BWB, in which:

FIG. 7(A) is a plan view of the mounted terminals; and

FIG. 7(B) is a cross-sectional view taken on line 7(B)—7(B) of FIG. 7(A); and FIGS. 8(A) and 8(B) are cross-sectional views which are useful in explaining a problem which can be caused by fixing the conventional press-fit terminal by a screw in which:

FIG. 8(A) shows a case where a screw having an appropriate length is used; and FIG. 8(B) shows a case where a long screw is used.

DESCRIPTION OF THE PREFERRED EMBODIMENT

The present invention will now be described with reference to the accompanying drawings.

Figure 1:
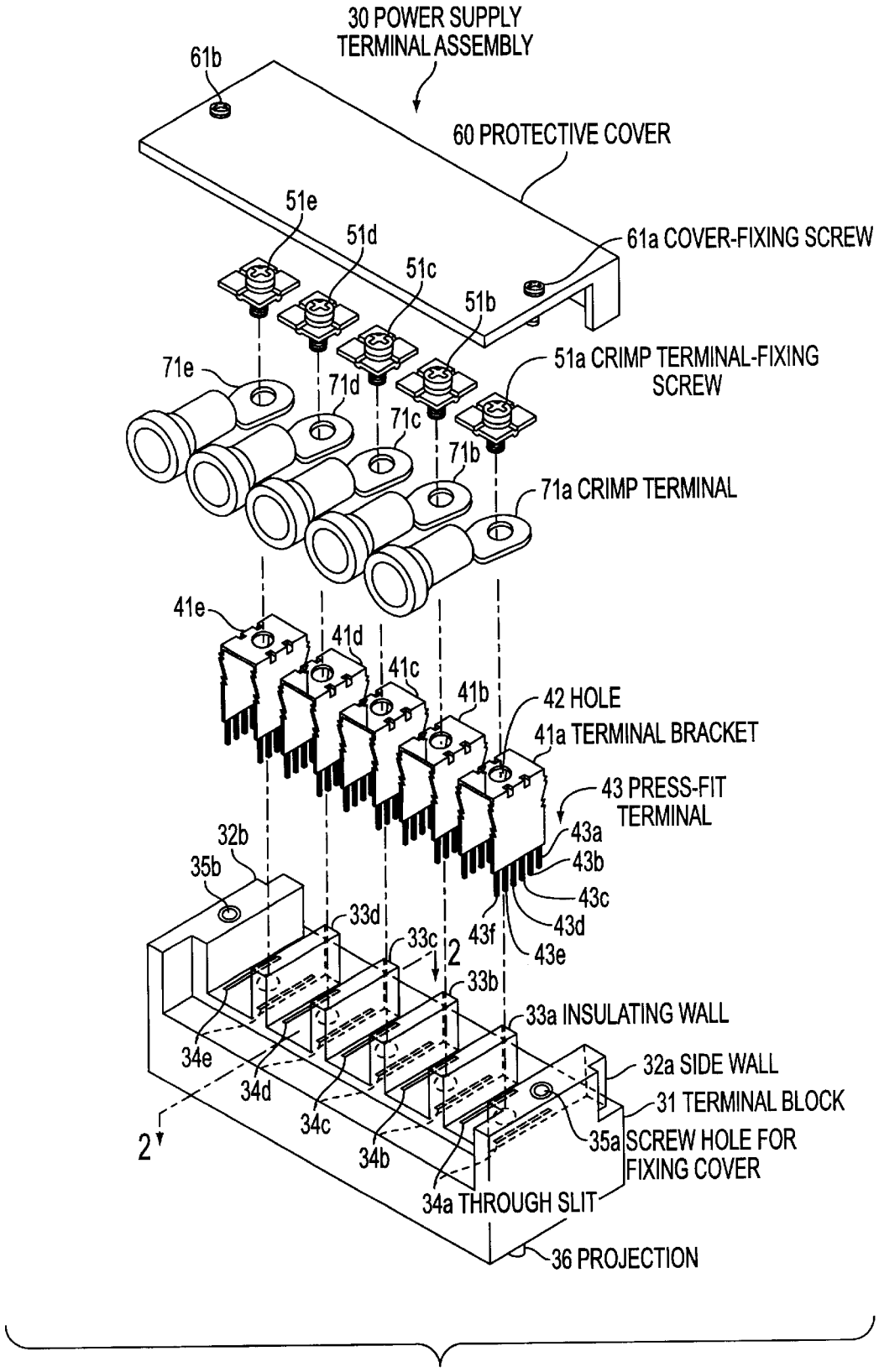
FIG. 1 is an exploded perspective view of a power supply terminal assembly according to the present invention.

FIG. 1 shows a power supply terminal assembly of the present invention in an exploded state.

Figure 2:
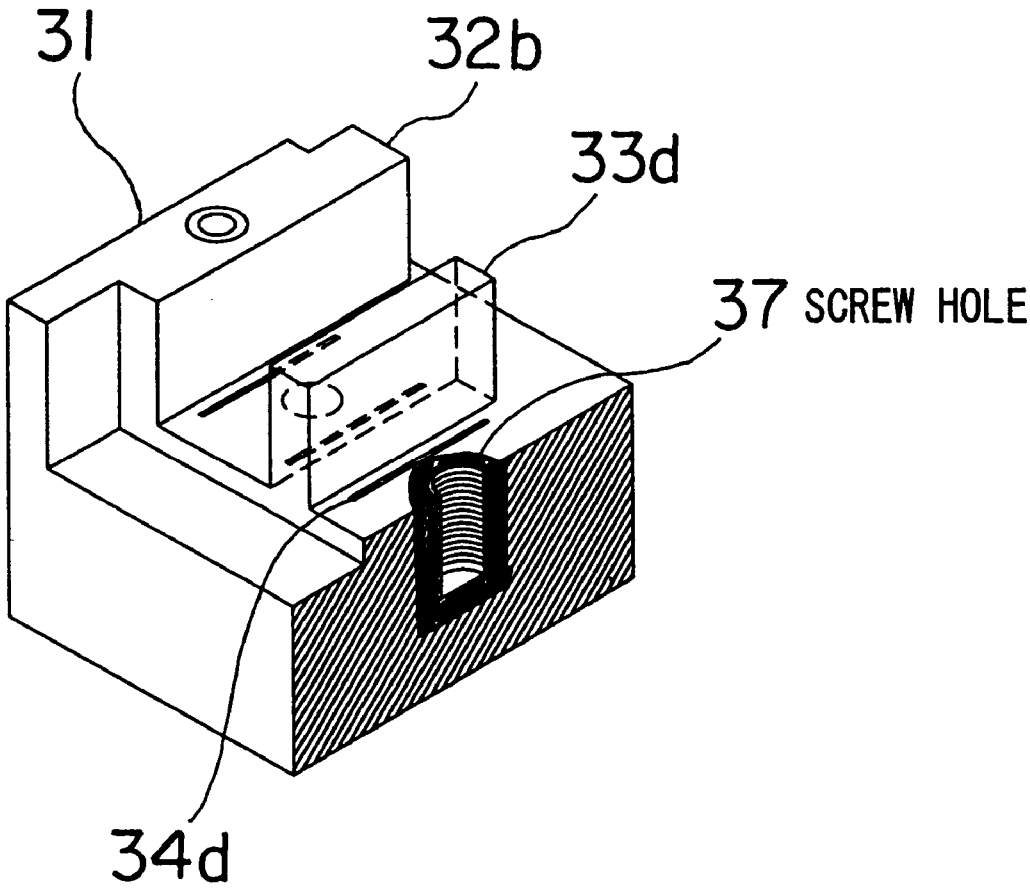
FIG. 2 is a partial perspective view of a terminal block appearing in FIG. 1, taken on line 2—2 of FIG. 1.

FIG. 2 is a partial perspective view of a terminal block appearing in FIG. 1, taken on line 2—2 of the figure.

Figure 3A:
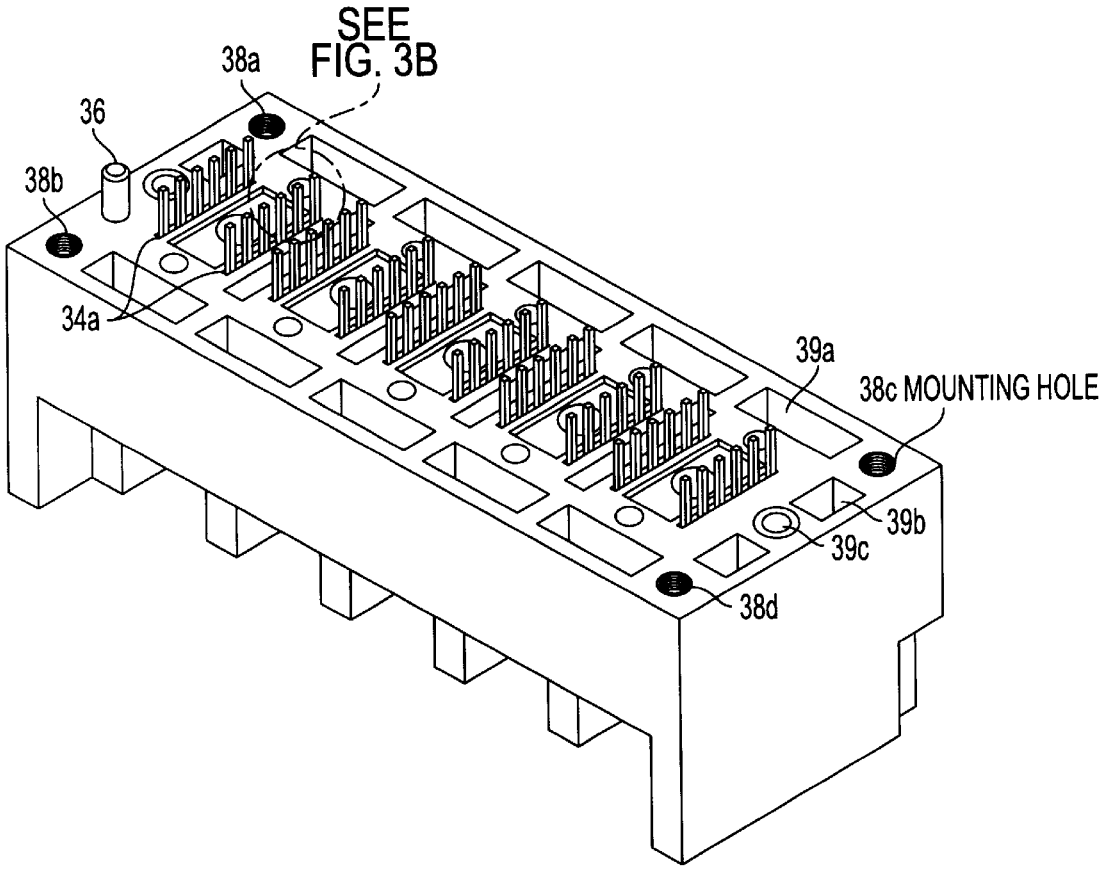
FIG. 3 is a perspective view showing a bottom surface of the terminal block.
Figure 3B:
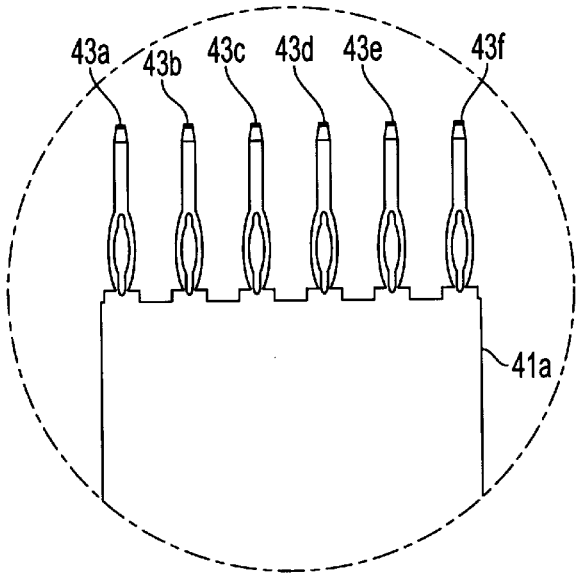

FIG. 3 shows a bottom surface of the terminal block in perspective.

The power supply terminal assembly 30 shown in FIG. 1 is a five-electrode type. The power supply terminal assembly 30 basically includes a terminal block 31, five terminal brackets 41*a* to 41*e*, five crimp terminal-fixing screws 51*a* to 51*e* each having a washer, and a protective cover 60.

The terminal block 31 generally in the form of a rectangular parallelepiped is made of PBT (polybutylene terephthalate). The terminal block 31 has opposite side walls 32*a*, 32*b* protruding upward as viewed in FIG. 1 and formed with respective screw holes 35*a*, 35*b* for use in securing the protective cover 60 to the terminal block 31 by screws. Further, between the side walls 32*a*, 32*b*, four insulating walls 33*a* to 33*d* protrude upward as viewed in FIG. 1 at equally spaced intervals in parallel with the side walls 32*a*, 32*b*. A plurality of pairs of through slits 34*a* to 34*e* in which the terminal brackets 41*a* to 41*e* are fitted respectively are formed in parallel with each other through flat portions between the insulating walls 33*a* to 33*d* and between the insulating walls 33*a*, 33*d* and the side walls 32*a*, 32*b*.

Further, as shown in FIG. 2, formed at a center of each of the flat portions between the through slits 34*a* to 34*e* is a non-through or bottomed screw hole 37 for screwing a corresponding one of the crimp terminal-fixing screws 51*a* to 51*e* therein. Each of the screw holes 37 is integrally formed in the terminal block 31 by embedding a female-threaded cylindrical metal member therein.

Since the power supply terminal assembly 30 is symmetrically shaped, the side wall 32*a* has a projection 36 formed on a bottom surface thereof, as shown in FIGS. 1 and 3, for prevention of erroneous mounting of the power supply terminal assembly 30 onto a BWB. Further, as shown in FIG. 3, the bottom surface of the terminal block 31 has mounting holes (screw holes) 38*a* to 38*d* formed in four corners thereof, respectively, for use in mounting the power supply terminal assembly 30 onto the BWB. Rectangular and circular holes designated by reference numerals 39*a*, 39*b*, and 39*c* on behalf of the others appearing in FIG. 3 are recesses formed when the terminal block 31 is formed.

The terminal brackets 41*a* to 41*e* appearing in FIG. 1 are each formed by bending a flat nickel-plated plate of phosphor bronze into a U-shape, and forming a comb teeth-shaped press-fit terminal 43 comprised of six terminal pins 43*a* to 43*f* (see FIG. 3) at an end of each of side plate portions of the bent plate opposed in parallel to each other and a hole 42 at a center of a flat central plate portion bridging the opposite side plate portions. The crimp terminal-fixing screws 51*a* to 51*e* are each screwed into a corresponding one of the holes 42 to secure a corresponding one of the crimp terminals 71*a* to 71*e* in a manner sandwiching the same between its washer and a corresponding one of the terminal brackets 41*a* to 41*e*.

The terminal pins 43*a* to 43*f* each have a root thereof formed with a slim elliptical spring portion as shown in FIG. 3. When the press-fit terminal 43 is inserted into a through hole formed in the BWB, the spring portions of the respective terminal pins 43*a* to 43*f* fixedly secure the press-fit terminal 43 by their spring pressure.

Figure 4A:
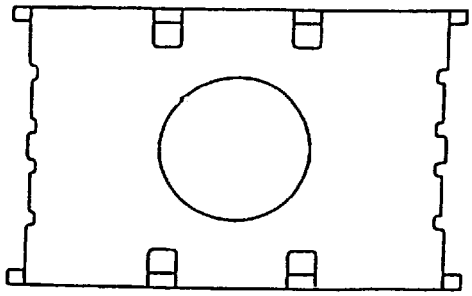
Figure 4B:
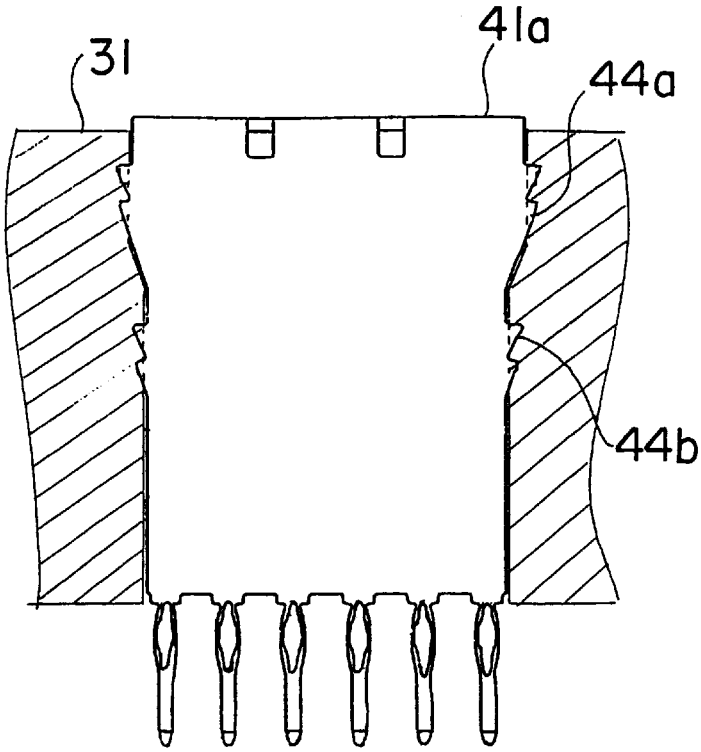
Figure 4C:
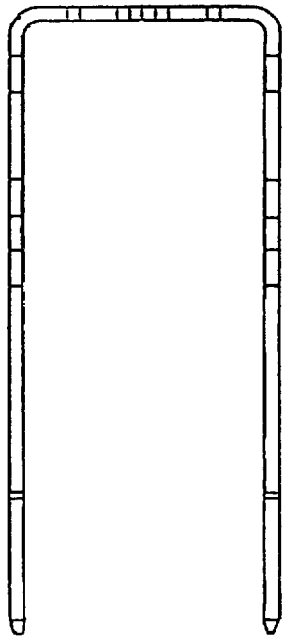

FIGS. 4(A) to 4(C) show the construction of the terminal bracket in detail. FIG. 4(A) is a plan view of the terminal bracket, FIG. 4(B) a front view of the same, and FIG. 4(C) a side view of the same.

As shown in FIG. 4(B), the side plate portions of the terminal bracket 41*a* each have two upper and lower portions which are different in width and formed with double wedge-shaped projections 44*a* and 44*b* projecting outward from each side edge of each of the side plate portions.

When the side plate portions of the terminal bracket 41*a* are each inserted into a corresponding one of the through slits 34*a* of the terminal block 31 in such a manner that the press-fit terminal pins 43*a* to 43*f* protrude from the bottom surface of the terminal block 31 as shown in FIG. 3, the double wedge-shaped projections 44*a* and 44*b* of the side plate portions of the terminal bracket 41*a* are brought into engagement with the through slits 34*a*. When a force is applied to the terminal bracket 41*a* in a direction opposite to a direction of insertion in this state, the projections 44*a*, 44*b* wedge into wall surfaces of the through slits 34*a*, whereby the terminal bracket 41*a* is fixedly fitted in the terminal block 31.

Further, the protective cover 60 appearing in FIG. 1 has two through holes formed through opposite end portions thereof, respectively, and cover-fixing screws 61*a*, 61*b* are inserted through the through holes and screwed into the screw holes 35*a*, 35*b*, respectively.

In assembling the component parts into the power supply terminal assembly 30, the press-fit terminals 43 of each of the terminal brackets 41*a* to 41*e* are inserted into a corresponding one of the pairs of through slits 34*a* to 34*e* of the terminal block 31, and then the terminal brackets 41*a* to 41*e* are each pushed downward as viewed in FIG. 1 until the central plate portion thereof formed with the hole 42 is brought into contact with a surface of the terminal block 31 formed with a corresponding one of the pairs of through slits 34*a* to 34*e*. This causes the terminal brackets 41*a* to 41*e* to be fitted in the terminal block 31 such that the press-fit terminals 43 are projected from the bottom surface of the terminal block 31 as shown in FIGS. 3 and 4(B).

Then, the crimp terminals 71*a* to 71*e* are fixed to the terminal brackets 41*a* to 41*e*, respectively, by screwing the crimp terminal-fixing screws 51*a* to 51*e* into the respective screw holes 37 of the terminal block 31.

Thereafter, the protective cover 60 is attached to the terminal block 31 by screwing the cover-fixing screws 61*a*, 61*b* into the screw holes 35*a*, 35*b*, respectively.

Figure 5:
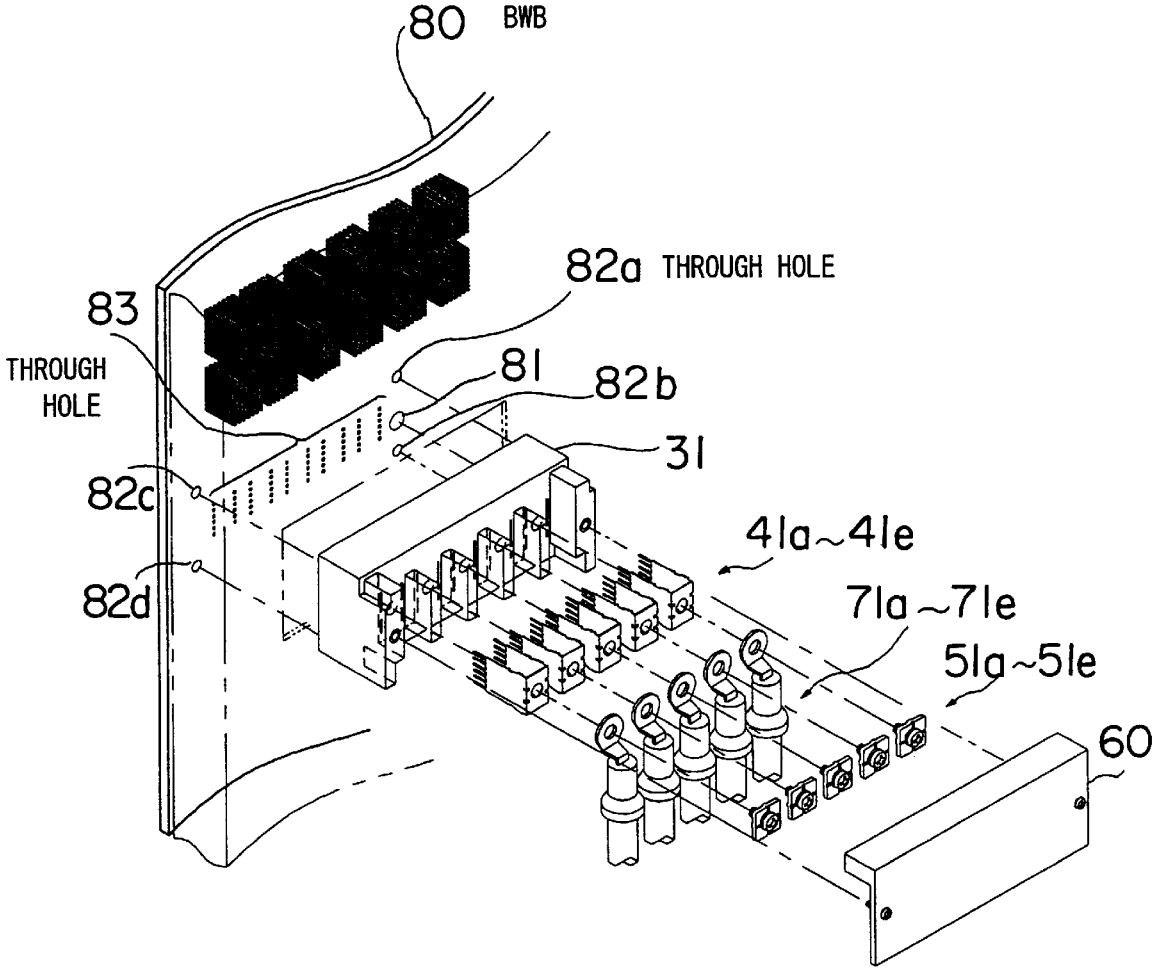
FIG. 5 is a view which is useful in explaining a procedure of mounting the power supply terminal assembly onto a BWB.
Figure 6A:
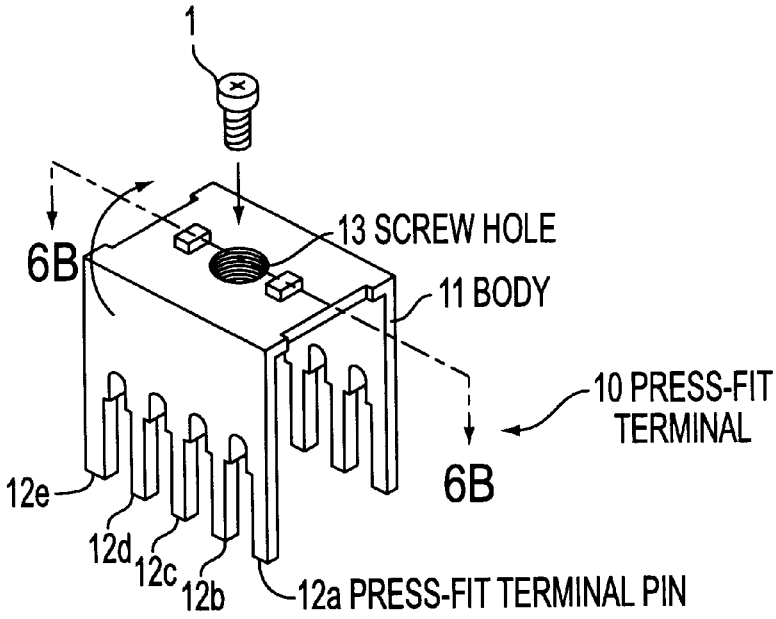
FIG. 6A (PRIOR ART)
FIG. 6(A) is a view which is useful in explaining the construction of a conventional press-fit terminal.
Figure 6B:
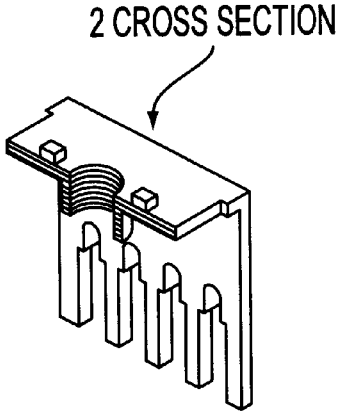
FIG. 6B (PRIOR ART)
FIG. 6(B) is a cross-sectional view taken on line 6(B)—6(B) of FIG. 6(A).
Figure 7A:
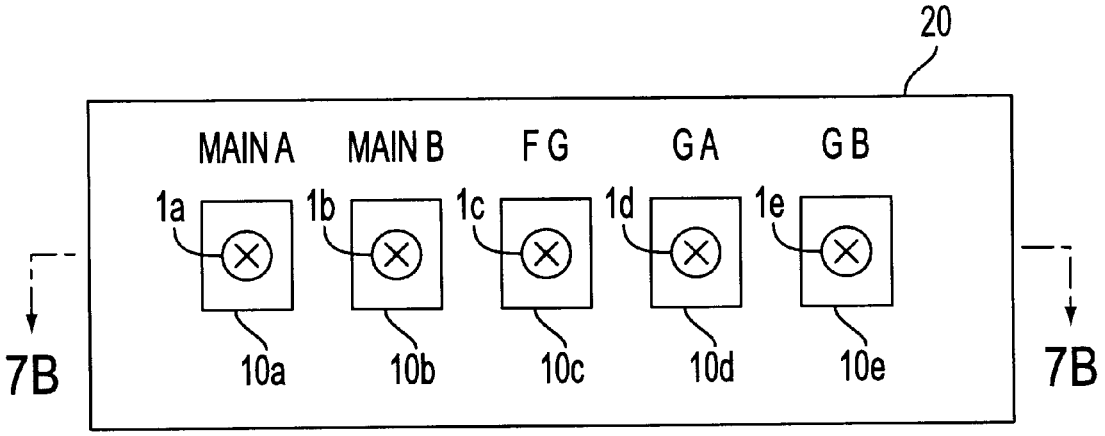
FIG. 7A (PRIOR ART)
Figure 7B:
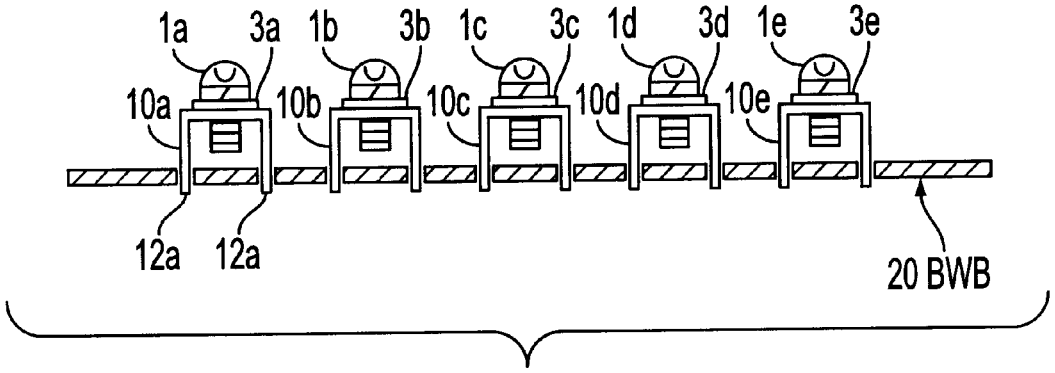
FIG. 7B (PRIOR ART)
Figure 8A:
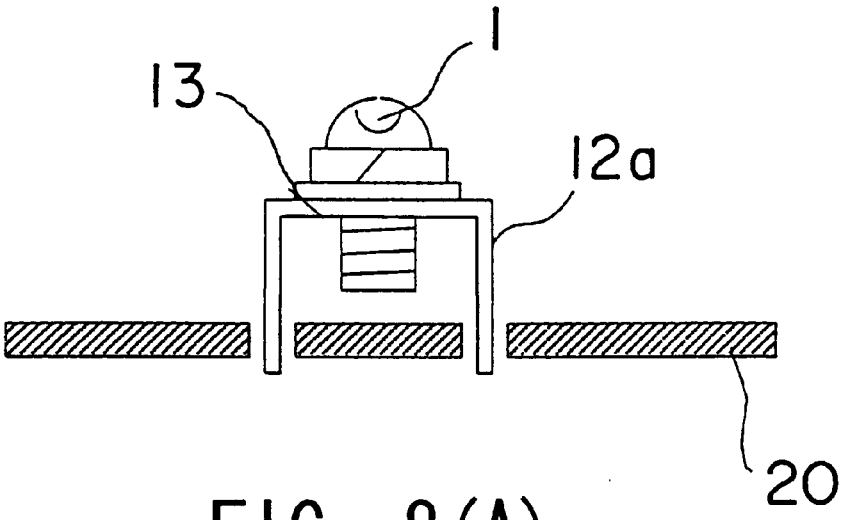
FIG. 8(A) PRIOR ART
Figure 8B:
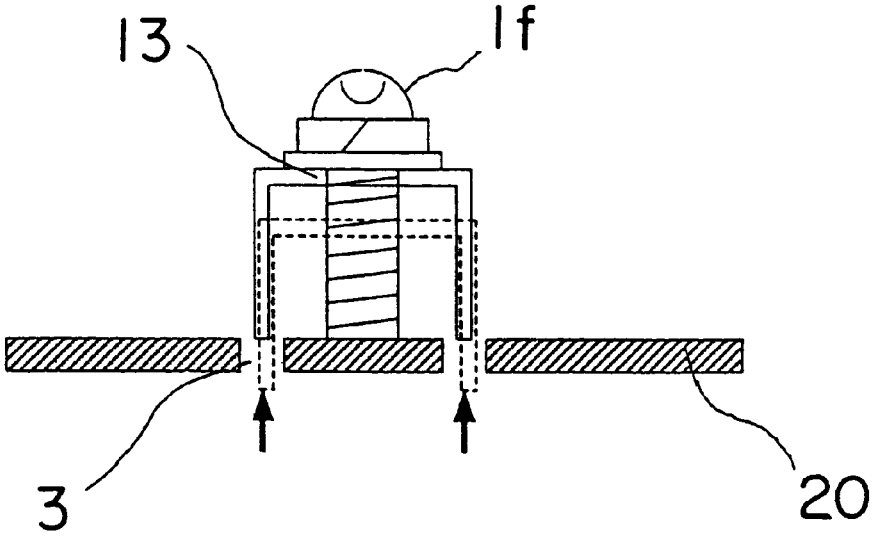
FIG. 8(B) PRIOR ART

Next, description will be made of a procedure of mounting the power supply terminal assembly 30 constructed as above onto a BWB 80, with reference to FIG. 5 which is useful in explaining the mounting procedure.

It should be noted that mounting of the power supply terminal assembly 30 onto the BWB 80 is carried out with the protective cover 60 and the crimp terminal-fixing screws 51*a* to 51*e* removed therefrom, so as to carry out cabling.

First, in this state, the projection 36 of the power supply terminal assembly 30 is caused to be aligned over a dovetail hole 81 of the BWB 80, and at the same time the press-fit terminals 43 are each caused to be aligned over a corresponding one of a plurality of through holes 83, and then the terminal block 31 is pushed into the BWB 80.

When the terminal block 31 is pushed in, the mounting holes 38*a* to 38*d* (see FIG. 3) are in a state aligned with through holes 82*a* to 82*d* of the BWB 80, respectively. Then, bolts, not shown, are inserted into the through holes 82*a* to 82*d* from behind the BWB 80 and screwed into the mounting holes 38*a* to 38*d*, respectively, to thereby secure the power supply terminal assembly 30 to the BWB 80.

Subsequently, the crimp terminals 71*a* to 71*e* each having a cable (not shown) connected thereto are fixed to the terminal brackets 41*a* to 41*e*, respectively, by the respective crimp terminal-fixing screws 51*a* to 51*e*, and then the protective cover 60 is attached to the terminal block 31.

Further, a power supply capacitor, not shown, is mounted between a power terminal, not shown, of the power supply terminal assembly 30 and a ground, not shown, of the same behind the BWB 80.

According to the embodiment described above, the power supply terminal assembly 30 for supplying electric power to the BWB 80 is comprised of the terminal block 31 having the pairs of through slits 34*a* to 34*e* formed therethrough and the screw holes 37 each formed between a corresponding one of the pairs of through slits 34*a* to 34*e* , and the terminal brackets 41*a* to 41*e* each bent into the U-shape and having the flat central plate portion formed with the hole 42 corresponding to the screw hole 37 and the opposite side plate portions each formed with the plurality of press-fit terminal pins 43*a* to 43*e* at an end thereof, the opposite side plate portions being inserted through a corresponding one of the pairs of through slits 34*a* to 34*e* and fixed thereat.

This embodiment makes it possible to complete a power supply terminal assembly 30 by fitting terminal brackets 41*a* to 41*e* in a terminal block 31 and then mount the same onto a BWB, which enhances working efficiency as well as mechanical strength of each power supply terminal. Further, since the number of the terminals can be determined based on power supply capacity, the freedom of design is increased.

Further, the pairs of through slits 34*a* to 34*e* are separated by the respective insulating walls 33*a* to 33*d*, so that even when the terminals are arranged close to each other, a feeder to be connected or actually connected to any one of the terminals is prevented from contacting an adjacent terminal as in the prior art.

Moreover, the screw holes 37 are non-through ones or bottomed, so that even if long screws are used as crimp terminal-fixing screws 51*a* to 51*e*, the screws are prevented from damaging the BWB by ends thereof, and the terminals are prevented from falling off.

Still further, the side plate portions of the respective terminal brackets 41*a* to 41*e* each have the two portions which are different in width and formed with the double wedge-shaped projections 44*a*, 44*b* at each side edge, so that it is possible to fixedly fit the terminal brackets 41*a* to 41*e* in the terminal block 31.

Although in the above embodiment, the power supply terminal assembly is a five-terminal type, it goes without saying that the present invention can be applied to a power supply terminal assembly having any number of terminals.

Further, although in the embodiment, the power supply terminal assembly is mounted on the BWB, this is not limitative, but the invention can also be applied to a power supply terminal assembly for supplying electric power to a board of general type.

As described above, the power supply terminal assembly of the invention is constructed such that the press-fit terminal brackets are fitted in the slits of the terminal block. Therefore, working efficiency in mounting the power supply terminal assembly onto a board is improved, and mechanical strength of each power supply terminal is also enhanced.

Further, since the number of the terminals can be determined based on power supply capacity, the freedom of design is increased.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A power supply terminal assembly for supplying electric power to a board, comprising:

a terminal block formed with a pair of through slits and a screw hole at a center between said pair of through slits;

a terminal bracket bent into a U-shape and having a flat central plate portion formed therethrough with a hole corresponding to said screw hole and opposite side plate portions each formed with a plurality of press-fit terminals with an elliptical spring portion at an end thereof, said opposite side plate portions being inserted through said pair of through slits, respectively, and fixed thereat, and each of said opposite side plate portions being formed by two portions which are different in width and each formed with a wedge-shaped projection.

2. A power supply terminal assembly according to claim 1, wherein insulating walls are formed on opposite sides of said pair of through slits.

3. A power supply terminal assembly according to claim 1, wherein said screw hole is a non-through one.

4. A back wiring board on which a power supply terminal assembly having a plurality of press-fit terminals is mounted, said power supply terminal assembly, comprising:

a terminal block formed with a pair of through slits and a screw hole at a center between said pair of through slits;

a terminal bracket bent into a U-shape and having a flat central plate portion formed therethrough with a hole corresponding to said screw hole and opposite side plate portions each formed with a plurality of press-fit terminals with an elliptical spring portion at an end thereof, said opposite side plate portions being inserted through said pair of through slits, respectively, and fixed thereat, and each of said opposite side plate portions being formed by two portions which are different in width and each formed with a wedge-shaped projection.

* * * * *